United States Patent [19]

Bolduc

[11] Patent Number: 4,620,144

[45] Date of Patent: Oct. 28, 1986

[54] SELF-CONTROLLED VARIABLE INDUCTOR WITH AIR GAPS

[75] Inventor: Léonard Bolduc, Ste-Julie, Canada

[73] Assignee: Hydro-Quebec, Montreal, Canada

[21] Appl. No.: 734,099

[22] Filed: May 15, 1985

[30] Foreign Application Priority Data

Jan. 16, 1985 [CA] Canada ..... 472204

[51] Int. Cl.[4] ..... G05F 1/325

[52] U.S. Cl. ..... 323/331; 323/334; 323/250; 363/91

[58] Field of Search ..... 323/249, 250, 251, 308, 323/310, 329, 331, 332, 334; 363/75, 82, 90–93; 336/155, 160, 165, 178, 186

[56] References Cited

U.S. PATENT DOCUMENTS

| | | | |
|---|---|---|---|
| 1,813,409 | 7/1931 | Kouyoumjian | 323/334 |
| 2,686,292 | 8/1954 | Macklem | 323/334 |
| 2,743,152 | 4/1956 | Carleton | 363/93 X |
| 2,957,086 | 10/1960 | Pettit, Jr. | 323/331 X |
| 3,373,347 | 3/1968 | Maka | 323/250 |

FOREIGN PATENT DOCUMENTS

| | | |
|---|---|---|
| 1044262 | 6/1958 | Fed. Rep. of Germany . |
| 1011769 | 8/1952 | France . |
| 1597469 | 6/1970 | France . |
| 2025429 | 9/1970 | France . |

OTHER PUBLICATIONS

The Theory and Design of Magnetic Amplifiers (1958) by E. H. Frost-Smith; pp. 20, 33, 34, 41, 51 and 97.

IEEE Transactions on Power Apparatus and Systems vol. PAS. 101, No. 9, Sep. 1982, "A Current Limiting Device Using Superconducting D. C. Bias Application and Prospects" by B. P. Raju et al.

The Electronic Journal, Feb. 1937, "Direct-Current Controlled Reactors" by C. V. Aggers.

*Primary Examiner*—Peter S. Wong

*Attorney, Agent, or Firm*—Schwartz, Jeffery, Schwaab, Mack, Blumenthal & Evans

[57] ABSTRACT

An electric power apparatus, namely a variable inductor comprising a magnetic core provided with a center limb and two outer limbs all having first and second ends. The first ends are interconnected through a first common point of the magnetic core, and the second ends through a second common point of this core. Two primary windings disposed respectively around the two outer limbs are connected in series and supplied with an alternating current, while two control windings also connected in series are respectively superposed to the two primary windings. The alternating current of the primary windings is rectified through a diode bridge for supplying with direct current the control windings. The direction of the different windings along with their interconnections are selected so that the alternating and direct currents induce in one of the two outer limbs alternating and direct current magnetic fluxes which assist each other or which are in opposition and in the other of these two limbs alternating and direct current magnetic fluxes which are in opposition or which assist each other, respectively, depending on the positive or negative value of the alternating current. Each outer limb comprises an air gap traversed by the resultant magnetic flux induced in this limb, and preferably disposed in the center of the corresponding primary and control windings.

30 Claims, 14 Drawing Figures

SELF-CONTROLLED VARIABLE INDUCTOR WITH AIR GAPS

BACKGROUND OF THE INVENTION

1. Field of the Invention

The present invention relates to an electric power apparatus, namely a variable inductor of the type comprising a magnetic core having three limbs, primary or input winding means supplied with alternating current, and a direct current control circuit.

2. Description of the prior art:

Conventionally, the primary winding means of such a variable inductor comprise at least one winding supplied with an alternating current which induces an alternating magnetic flux of a same density within two of the three limbs of the magnetic core. On the other hand, the control circuit is supplied with a direct current which induces a direct current magnetic flux of a same density within these two limbs. The alternating and direct current fluxes assist in one of the two limbs while they oppose in the other, and vice versa depending on the positive or negative value of the alternating current. The function of the direct current magnetic flux induced in each of the two limbs is to saturate more or less deeply the magnetic core for thereby determining the permeability of the latter to the alternating flux and thus the impedance of the primary winding means. This impedance may therefore be varied by modifying the amplitude of the direct current of the control circuit so as to modify the density of the direct current magnetic flux induced in the two limbs. A plurality of systems have been proposed to adjust the amplitude of this direct current whereby a desired operating characteristic of the variable inductor is obtained, some of these systems rectifying the alternating current of the primary winding means for supplying the control circuit with this rectified current.

These known variable inductors have the drawback that their operating characteristic is very sensitive to any variation in the intrinsic properties of the material constituting the magnetic core and in the construction of this core, to heating or to the slightest displacement in the magnetic core, and also to the effect related to the frequency. Moreover, such inductors of the prior art do not allow to obtain an operating characteristic which would provide an optimum range of variation of the alternating current in the primary winding means and therefore of the reactive power of the variable inductor in response to a slight variation of the voltage between the terminals of these primary winding means, and that at a given voltage level. Such an operating characteristic would be very useful for an application of the variable inductor for example to the regulation of alternating voltage.

SUMMARY OF THE INVENTION

The principal object of the present invention is therefore to eliminate the different drawbacks discussed hereinabove by introducing gap means in each of the two limbs of the magnetic core where the alternating and direct current magnetic fluxes assist or oppose.

More particularly, the present invention proposes a variable inductor comprising:

a magnetic core provided with three limbs each having a first end and a second end, these first ends being interconnected through a first common point of the magnetic core, and these second ends being interconnected through a second common point of the magnetic core;

primary winding means supplied with an alternating current;

control winding means; and means for supplying the control winding means with a direct current having an amplitude which varies in relation with an electric parameter related to the operation of the variable inductor;

the primary winding means and the control winding means being disposed with respect to the magnetic core so that the alternating and direct currents induce in a first of the three limbs an alternating magnetic flux and a direct current magnetic flux which assist each other or which are in opposition with respect to each other when the alternating current has a positive or negative value, respectively, and in a second of the three limbs an alternating magnetic flux and a direct current magnetic flux which are in opposition with respect to each other or which assist each other when the alternating current has a positive or negative value, respectively, the direct current magnetic flux induced in each of the first and second limbs having a density which varies with the amplitude of the direct current for thereby varying the impedance of the primary winding means;

the first limb comprising gap means traversed by the resultant magnetic flux induced in this first limb, and the second limb comprising gap means traversed by the resultant magnetic flux induced in this second limb.

According to a preferred embodiment of the invention, the electric parameter is the amplitude of the alternating current supplying the primary winding means, and the direct current supplying means comprise a diode bridge serially interconnecting the primary winding means with the control winding means for thereby rectifying the alternating current flowing through the primary winding means and supplying the control winding means with this rectified current (self-control operation).

According to another preferred embodiment of the invention, the primary winding means comprise a first winding and a second winding connected in series, wrapped around the first and second limbs, respectively, and supplied with the alternating current so that this alternating current induces in the first limb a first alternating magnetic flux and in the second limb a second alternating magnetic flux, which first and second alternating magnetic fluxes assist each other in the third of said three limbs, and the control winding means comprise a third winding superposed to the first winding and a fourth winding superposed to the second winding, these third and fourth windings being connected in series, wrapped around the first and second limbs, respectively, and supplied with the direct current so that this direct current induces a direct current magnetic flux flowing through a closed magnetic circuit defined by the first and second limbs.

Preferably, the first and third windings are disposed around the first limb so that the gap means of this first limb are located in the center of these first and third windings, and the second and fourth windings are also disposed around the second limb so that the gap means of this second limb are located in the center of these second and fourth windings.

The variable inductor may also comprise bias winding means mounted on the magnetic core and supplied with direct current, as well as an inductor having a fixed value and connected in series with the control winding means.

BRIEF DESCRIPTION OF THE DRAWINGS

The objects, advantages and other features of the present invention will become more apparent upon reading of the following description of a preferred embodiment thereof, given as a non-limitative example only with reference to the accompanying drawings, in which:

FIG. 1(*b*) illustrates a possible cross section for the three limbs of the magnetic core of the inductor of FIG. 1(*a*);

FIG. 1(*c*) is the equivalent circuit of the self-controlled variable inductor provided with air gaps of FIG. 1(*a*);

Figure 1A:
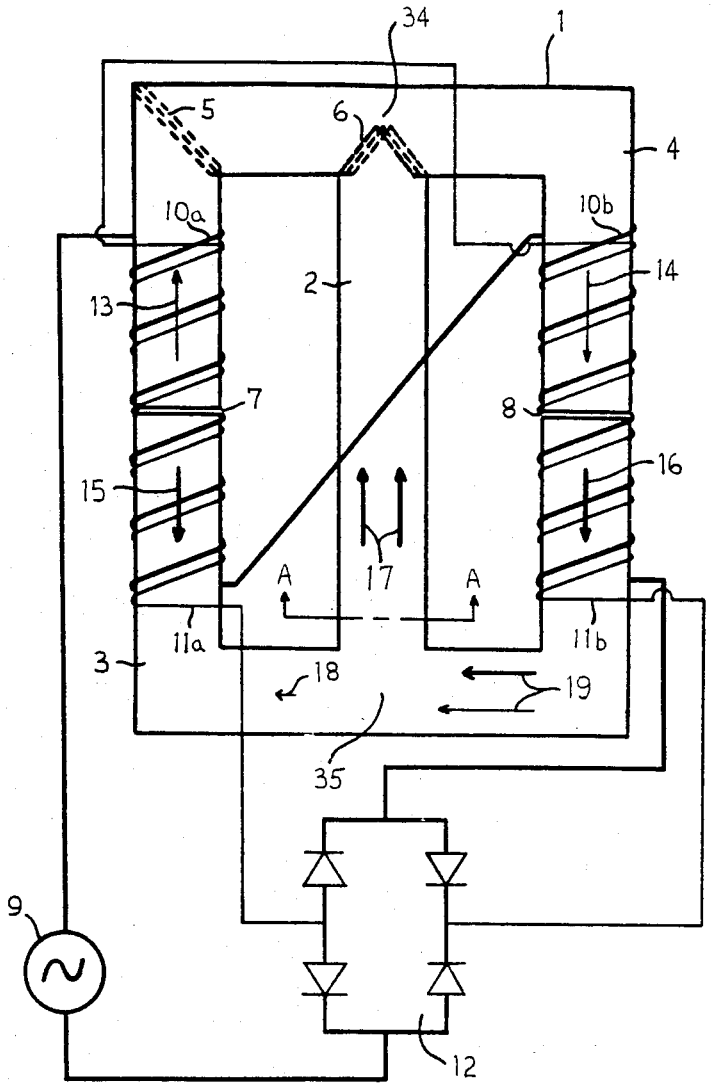
FIG. 1(*a*) represents a self-controlled variable inductor provided with air gaps according to the invention, which inductor includes a three limbed magnetic core.
Figure 1B:
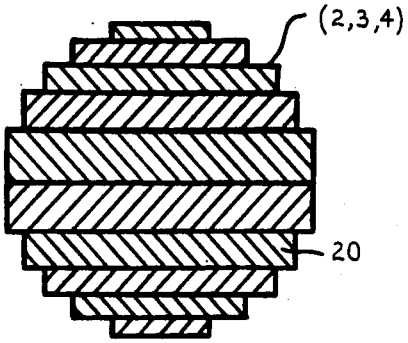
Figure 1C:
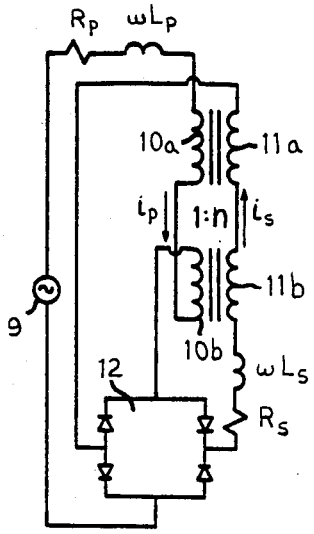
Figure 7:
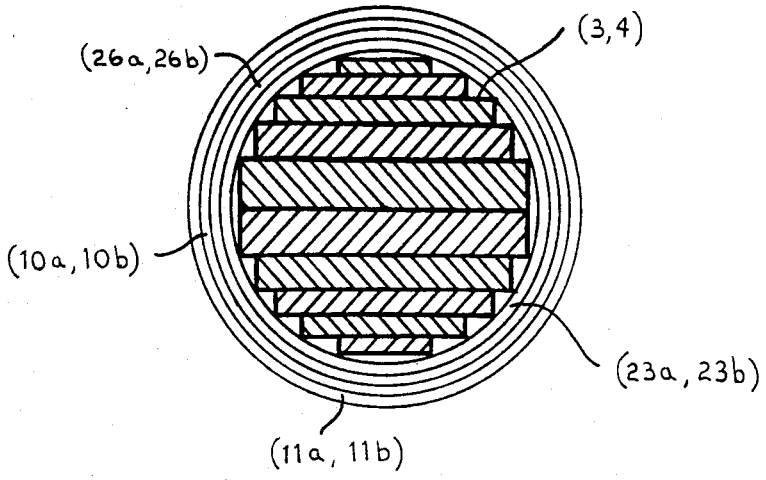
Figure 8A:
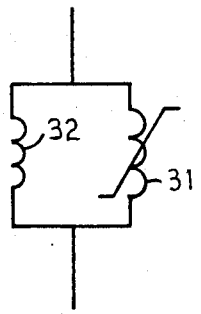
Figure 8B:
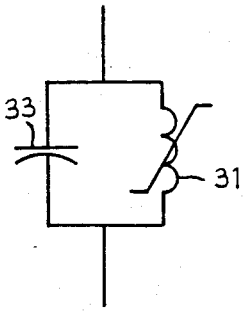
Figure 8C:
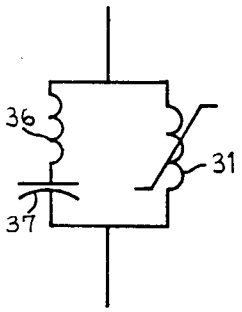
Figure 9:
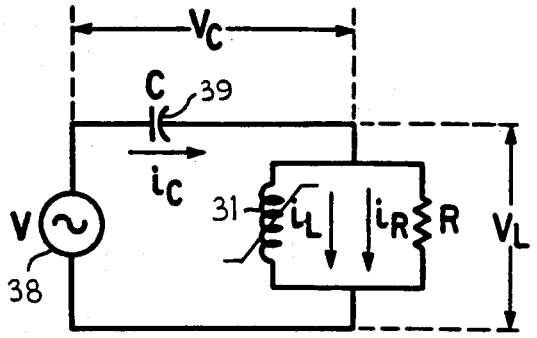

FIG. (6*a*) and (6*b*) illustrate circuits, under the form of equivalent the addition of components allowing an adjustment of the operating characteristics of the variable inductor of FIG. 1(*a*);

FIG. 7 represents a superposition of windings around two limbs of the magnetic core of the inductor according to the invention;

FIGS. 8(*a*), 8(*b*) and 8(*c*) show how to modify the operating characteristics of the variable inductor for an application to voltage regulation; and FIG. 9 illustrates an application of the variable inductor to the regulation of alternating voltage in the case of a supply by capacitive coupling, for example by overhead wire.

DETAILED DESCRIPTION OF THE PREFERRED EMBODIMENT

The variable inductor comprises, as illustrated on FIG. 1(*a*) of the drawings, a magnetic core generally identified by the reference 1 and formed with a center limb 2 and with two outer limbs 3 and 4, these three limbs being all disposed substantially in a same plane in order to facilitate the construction of the magnetic core 1. The three limbs have their first ends interconnected through a first common point 34 while their second ends are interconnected through a second common point 35. The magnetic core is advantageously constituted by stacked sheets, which sheets being parallel to the plane in which are located the three limbs. These sheets are identified by the reference 20 on FIG. 1(*b*) which represents the cross-section of the limbs 2 to 4 taken for the purpose of exemplification along the axis A—A of FIG. 1(*a*). The number and the thickness of the sheets 20 forming the different limbs of the magnetic core 1 can of course be selected according to the usual criteria for the design of such magnetic cores.

As illustrated on FIG. 1(*b*), the center limb 2 and the outer limbs 3 and 4 each have a cruciform cross section which is almost circular and which has a same area.

However, although it is important that the cross section of the outer limbs 3 and 4 has a same area, the cross section of the center limb 2 may have an area equal to or greater than that of the cross section of the limbs 3 and 4. These three limbs 2, 3 and 4 may also have a square or rectangular cross section.

For reasons which will become evident upon reading of the following description, it is important that the sheets 20 of the magnetic core be made of a magnetic steel or of any other magnetic material having a magnetization curve with a pronounced knee. In order to prevent the phenomenons of partial saturation in the region of the joints of these sheets 20, which phenomenons straighten the knee of the magnetization curve, the sheets 20 should be joined through 45° joints having at least three stages, as illustrated for example at 5 and 6 on FIG. 1(*a*).

Referring now back to this FIG. 1(*a*), the outer limb 3 of the core comprises at its center an air gap 7 while the outer limb 4 has at its center an air gap 8, these two air gaps 7 and 8 having an identical length.

First winding means that is convenient here to call "primary winding means" are supplied with alternating current through an electric alternating source 9 and comprise a first winding 10*a* disposed around the outer limb 3 and a second winding 10*b* disposed around the outer limb 4. There are also provided control winding means comprising a first winding 11*a* superposed to the winding 10*a* and a second winding 11*b* superposed to the winding 10*b*. The windings 10*a* and 10*b* having a same number of turns are connected in series, and the windings 11*a* and 11*b* also having a same number of turns are also connected in series. Advantageously, the windings 10*a* and 11*a* are positioned around the outer limb 3 so that the air gap 7 is located in their center. In the same manner, the windings 10*b* and 11*b* are positioned around the outer limb 4 so that the air gap 8 is located in their center. This disposition of the windings is advantageous because it considerably reduces the leakage fluxes in the area of the air gaps.

A full wave rectifier bridge 12 comprising four diodes rectifies the alternating current flowing through the primary winding means for the purpose of supplying the control winding means with this rectified current to thereby obtain a self-control operation of the variable inductor. It is convenient here to call this rectified current "direct current".

In fact, the rectifier bridge 12 interconnects directly in series the primary and control winding means between the terminals of the source 9 so that the alternating current of the primary winding means can be rectified for the purpose of supplying the control winding means. The amplitude of the direct current flowing through the serially interconnected windings 11*a* and 11*b* is therefore function of the amplitude of the alternating current flowing through the windings 10*a* and 10*b* also connected in series.

The direction of the windings 11*a* and 11*b* as well as their series interconnection are selected so that the direct current of the control winding means induces a direct current magnetic flux flowing through a closed magnetic circuit defined by the outer limbs 3 and 4. Consequently, no direct current magnetic flux results in the center limb. The direct current magnetic flux generated through the windings 11*a* and 11*b* within the two outer limbs 3 and 4 is identified by the arrows 13 and 14, respectively. The function of this induced magnetic flux is to saturate more or less deeply the magnetic core 1, whereby the impedance of the primary winding means is reduced and the alternating current through these winding means is increased, and that until a stable point is reached.

Each time the value of the alternating current flowing through the primary winding means is positive, the windings 10*a* and 10*b* generate respectively alternating magnetic fluxes identified by the arrows 15 and 16. These alternating fluxes 15 and 16 assist each other in the center limb 2 as illustrated at 17.

The direct current magnetic flux 13 and the alternating magnetic flux 15 are opposite to each other for giving the resultant magnetic flux identified by the arrow 18 within the outer magnetic limb 3. On the contrary, the direct current magnetic flux 14 and the alternating magnetic flux 16 assist each other within the outer limb 4. The latter addition of magnetic fluxes is illustrated by the arrows 19.

Of course, the superimposition of alternating and direct current magnetic fluxes described hereinabove is produced when the alternating current delivered from the source 9 has a positive value. It can be easily appreciated that an inverse phenomenon is produced when the alternating current flowing through the windings 10*a* and 10*b* has a negative value as in this case, the alternating magnetic fluxes induced by these windings 10*a* and 10*b* within the outer limbs 3 and 4 flow in opposite directions.

It should be pointed out that even in the case where the center limb 2 of the magnetic core 1 has a cross section of a same area as each of the two outer limbs 3 and 4, it cannot become saturated due to the distribution of magnetic flux described hereinabove, to the remanent flux and to the fact that the other limbs of the magnetic core when saturated allow leakage fluxes which do not attain the center limb 2.

FIG. 1(*c*) represents the equivalent circuit of the self-controlled variable inductor provided with air gaps of FIG. 1(*a*). The impedance of the primary circuit (comprising the windings 10*a* and 10*b* connected in series) can be represented by a resistance $R_p$ in series with a reactive impedance $\omega L_p$ while the impedance of the control winding means (windings 11*a* and 11*b* connected in series) can be represented by a resistance $R_s$ in series with a reactive impedance $\omega L_s$, where $L_p$ is the inductance value of the primary circuit comprising the windings 10*a* and 10*b* connected in series, $L_s$ is the inductance value of the windings 11*a* and 11*b* connected in series, and $\omega$ is the angular frequency $2\pi f$ at the frequency f of the alternating current of the primary winding means. The current $i_p$ is the alternating current which flows through the primary winding means and the current $i_s$ represents the direct current flowing through the control winding means and proudced from the rectifying of the current $i_p$ through the rectifier bridge 12. It should be pointed out that the current $i_s$ flows always in the same direction as it corresponds to the rectified current delivered by the rectifier bridge 12. As can be appreciated, the indicia p is associated to the primary winding means while the indicia s is associated to the control winding means.

As illustrated of FIG. 1(*c*) the winding 11*a* of the control winding means has a number of turns equal to n times the number of turns of the winding 10*a* of the primary winding means, n being slightly greater than 1. Accordingly, the winding 11*b* has a number of turns equal to n times the number of turns of the winding 10*b*.

As the ratio n of the number of turns of the windings 11*a* and 11*b* of the control winding means and of the number of turns of the windings 10*a* and 10*b* of the primary winding means is slightly greater than 1, and as the rectified control direct current $i_s$ flowing through the windings 11*a* and 11*b* has always an amplitude equal to or greater than the modulus of the alternating current $i_p$, the resultant magnetic flux in each outer limb 3 or 4 has always a same polarity, namely the polarity imposed by the direct current $i_s$ by inducing a corresponding magnetic flux (see arrows 18 and 19 of FIG. 1(*a*) ), in the absence of bias windings which can be added as it will be described hereinafter.

Figure 2:
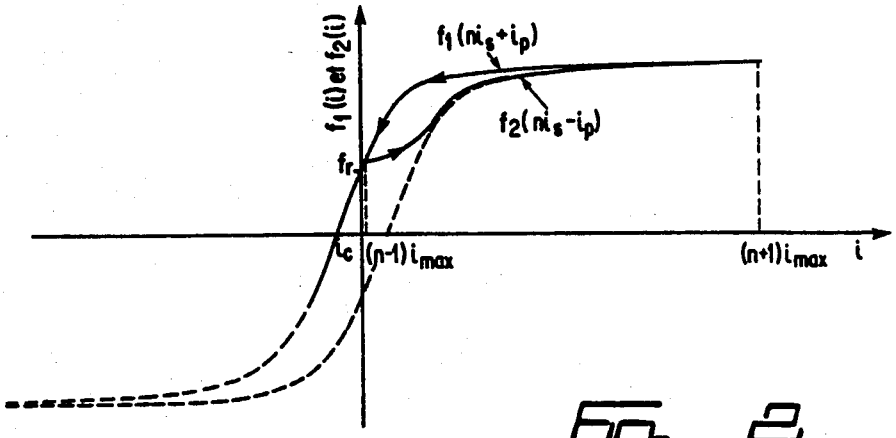
FIGS. 2, 3, 4 and 5 show different real or theoretical curves of operation of the variable inductor of FIG. 1(*a*)

The magnetic circuit of the outer limb 3 being identical to that of the outer limb 4, the magnetic fluxes are the same in one or the other of these two limbs, but angularly out of phase by 180°. As the magnetic flux is produced in each limb according to a minor hysteresis loop, the curve of the magnetic flux versus the current i effective in the variable inductor is not the same when this current is decreasing and when this current is increasing. FIG. 2 illustrates such a minor hysteresis loop.

Starting from $i_s=i_p=i_{max}$, $i_{max}$ being the peak value of the alternating current $i_p$, the magnetic flux $f_1$ $(ni_s+i_p)$ in one of the outer limbs 3 and 4 reduces as the alternating current $i_p$ becomes closer to the value $-i_{max}$. In the meantime, the magnetic flux $f_2$ $(ni_s-i_p)$in the other of the outer limbs increases according to a different curve portion towards the magnetic flux value $F_2[(n+1)\,i_{max}]$. The minor hysteresis loop of FIG. 2 is therefore present for values of the current i located between $(n-1)\,i_{max}$ and $(n+1)\,i_{max}$ $i_c$ represents the coercive current while $f_r$ represents the remanent flux.

In the following explanations, sectionally linear theoretical model curves will be used. It will also be briefly discussed how to correct the so obtained results for taking into consideration the real curves, i.e. the minor hysteresis loop and the rounded knee of the magnetization curve.

Figure 3:
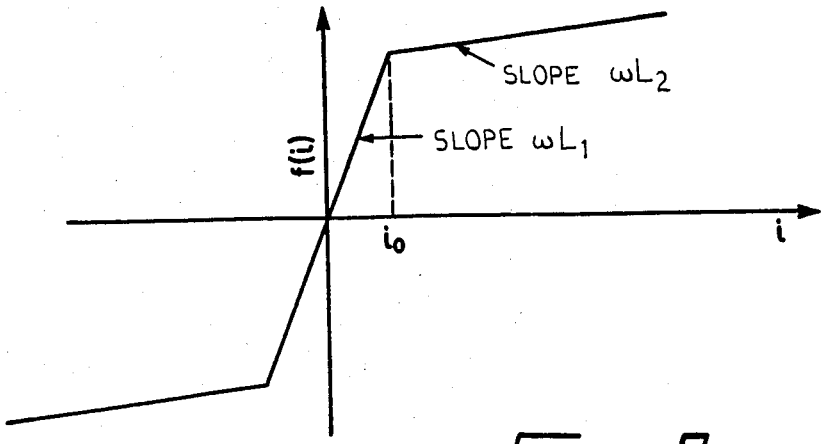

FIG. 3 illustrates a sectionally linear magnetization curve representing the voltage f(i) versus the current i, f(i) being the peak voltage at the frequency f of the alternating current $i_p$ required to obtain an induction level B, according to the relation $f(i)=N\omega BA$, where $\omega$ has already been defined, N is the number of turns of the winding means through which flows the alternating current, and A is the effective cross section of the magnetic core through which flows the magnetic flux. It is of course convenient to obtain a curve as close as possible to that of FIG. 3 for the operation of the self-controlled variable inductor provided with air gaps. The first linear section of the upper halfcurve of FIG. 3 between $i=0$ and $i=i_o$ follows slope $\omega L_1$ while the second linear section has a slope $\omega L_2$ for currents i greater than $i_o$, the current at the knee of the half-curve of FIG. 3.

Figure 4:
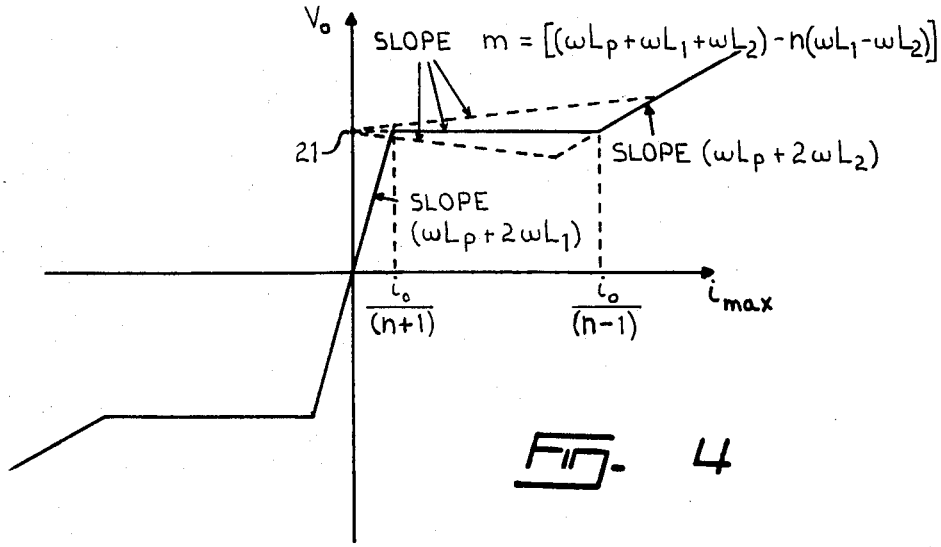

An interesting characteristic of the variable inductor is in steady state operation its operating peak voltage $V_o$ versus the peak current $i_{max}$. Considering the resistances $R_p$ and $R_s$ negligible compared with the reactive impedances $\omega L_p+2\omega L_2$ and $\omega L_s+2n^2\,\omega L_2$, the voltages between the terminals of the diodes when conducting negligible compared with the operating peak voltage $V_o$ of the variable inductor, a zero phase angle at the switching time, and the decreasing magnetic flux $f_1$ $(ni_s+i_p)$ identical to the increasing magnetic flux $f_2$ $(ni_s-i_p)$, i.e. without hysteresis loop, it can be mathematically demonstrated that in steady state operation and in the case where the magnetization half-curve is formed of two linear sections, as illustrated on FIG. 3, the curve of the peak voltage $V_o$ versus the peak current $i_{max}$ is formed of three linear sections of different slopes. FIG. 4 illustrates this curve of $V_o$ versus $i_{max}$.

The first linear section of the upper half-curve of FIG. 4 for $0 \leqq i_{max} \leqq i_o/(n+1)$ has a slope $(\omega L_p+2\omega L_1)$.

The voltage $V_o$ therefore follows this slope from zero up to $(\omega L_p+2\omega L_1)\ i_o/(n+1)$.

The second linear section of the half-curve of FIG. 4 for $i_o/(n+1) \leqq i_{max} \leqq i_o/(n-1)$ has a slope:

$$m=[(\omega L_p+\omega L_1+\omega L_2)-n(\omega L_1-\omega L_2)] \quad (1)$$

The value of the operating peak voltage $V_o$ therefore follows a linear curve section from $$V_o=(\omega L_p+2\omega L_1)\ i_o/(n+1) \text{ to } V_o=(\omega L_p+2\omega L_2)\ i_o/(n-1),$$

as the current $i_{max}$ varies from $i_o/(n+1)$ to $i_o/(n-1)$, according to the slope m.

In the region where the current $i_{max} \geqq i_o/(n-1)$, a third section of the half-curve of FIG. 4 has a slope $(\omega L_p+2\omega L_2)$ according to which the voltage $V_o$ varies in function of $i_{max}$.

The different slopes of the linear sections of the half-curve of FIG. 4 demonstrate that the operating peak voltage $V_o$ of the inductor depends on the input reactive impedance of the primary winding means $(\omega L_p)$ and not on the reactive impedance of the control winding means $\omega L_s$. This conclusion is completely general and can be applied to a model magnetization curve as illustrated on FIG. 3 as well as to a minor hysteresis loop as illustrated on FIG. 2.

From the expression of the slope m, it can be appreciated that an appropriate choice of the turn ratio n allows to modify at will the slope of the voltage $V_o$ versus the current for the values of $i_{max}$ located between $i_o/(n+1)$ and $i_o/(n-1)$.

Indeed, for $$(\omega L_p + 2\omega L_1)\frac{i_o}{(n+1)} = (\omega L_p + 2\omega L_2)\frac{i_o}{(n-1)}$$

i.e. for $$n = \frac{(\omega L_p + \omega L_1 + \omega L_2)}{(\omega L_1 - \omega L_2)} \quad (2)$$

the slope m is equal to zero and a constant value of the voltage in function of the current $i_{max}$ is obtained for the center linear section of the half-curve of FIG. 4, namely $V_o=(\omega L_1-\omega L_2)\ i_o$.

It should be noted that the value of the voltage $V_o=(\omega L_1-\omega L_2)\ i_o$ corresponds on the curve of FIG. 3 to the intersection point of the vertical axis f(i) with the prolongation of the section of slope $\omega L_2$.

When it is desired to obtain a positive or negative slope m, it is sufficient to modify appropriately the ratio n of number of turns. The slope m is as sensitive to the value of the ratio n as $(\omega L_p+2\omega L_2)/(\omega L_p+2\omega L_1)$ is small. Even if the slope m is modified, the intersection point 21 between the vertical axis $V_o$ and the prolongation of the center linear section of the half-curve of FIG. 4 is always the same. It should be noted that the same phenomenon is produced on the lower half-curve of FIG. 4.

Using the model of FIG. 3 and developing in series of Fourier expressions obtained mathematically for representing the alternating current $i_p$ in the primary winding means of the variable inductor, it is possible to obtain the expression of the harmonic components of this current $i_p$. At the two ends of the range of the current $i_p$, namely for $0 \leqq i_{max} \leqq i_o/(n+1)$ and $i_{max} \geqq i_o/(n-1)$, $i_p$ is sinusoidal and therefore contains only the fundamental frequency. It is therefore in the interval between these two current range ends that the harmonic analysis of the current $i_p$ is to be carried out. Such an analysis demonstrates that the current $i_p$ has a high harmonic content except when its peak value is given by the following expression:

$$i_{max} = \frac{i_o}{n\left[1 - \frac{n(\omega L_1 - \omega L_2)}{(\omega L_s + n^2\omega L_2 + n^2\omega L_1)}\right]}$$

Figure 6A:
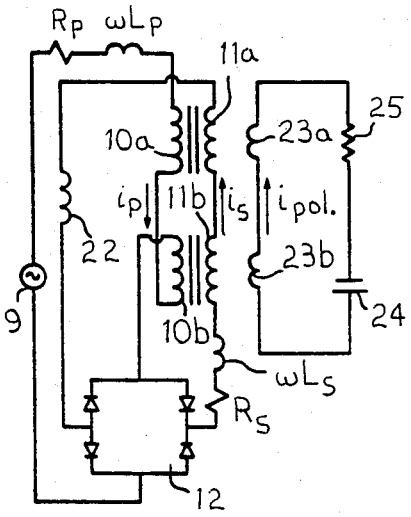

It is then perfectly sinusoidal. These results are important. Indeed, while for a given peak current $i_{max}$ the amplitude of the voltage $V_o$ is independent of $\omega L_s$ as explained hereinabove, it is possible to modify the waveform of the current to obtain a sinusoidal waveform by accurately adjusting the value of $\omega L_s$. That can be particularly useful when it is desired to limit the harmonics at a pre-established current $i_{max}$ and at a pre-established voltage $V_o$, for example for normal or nominal operation. This value of the reactive impedance $\omega L_s$ may be adjusted by introducing an inductor 22 having a fixed value in the control circuit, i.e. in series with the windings 11*a* and 11*b*, as illustrated in FIG. 6*a*). If insufficient, such harmonics can be filtered. In a three phase system, certain types of connections may be advantageously used, for example a delta connection of three self-controlled variable inductors with air gaps according to the present invention.

As it will be never possible to obtain exactly the magnetization curve used as model and illustrated on FIG. 3, as well as the curve of the voltage $V_o$ versus the current $i_{max}$ of FIG. 4, it is convenient to briefly discuss about the corrections to the theory for better adapting it to the reality.

Figure 5:
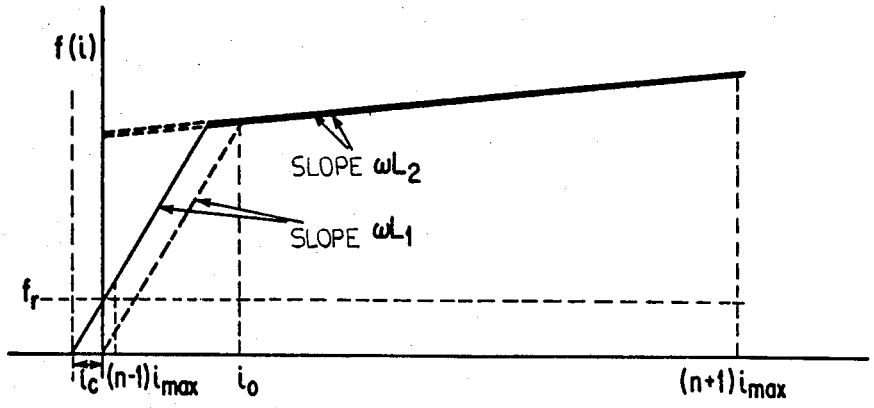

As mentioned hereinabove, the magnetic flux does not follow the magnetization curve used as model, but follows minor hysteresis loops having an upper limit at $(n+1)\ i_{max}$ and a lower limit at $(n-1)\ i_{max}$. While the magnetic flux in one of the outer limbs decreases from a maximum value which may correspond to a very deep saturation, at $(n+1)i_{max}$, towards a very smaller value, at $(n-1)i_{max}$, the magnetic flux in the other outer limb increases from its value at $(n-1)i_{max}$ to its value at $(n+1)i_{max}$. Even if it can be considered without introducing a noticeable error that the value of the magnetic flux at $(n+1)i_{max}$ corresponds to that on the model magnetization curve, the same does not apply for the value of the flux at $(n-1)i_{max}$ which corresponds to that on the curve of decrease of the magnetic flux on the hysteresis loop at the frequency of the alternating current $i_p$ having its upper limit at $(n+1)i_{max}$. It is consequently very difficult to accurately foresee the value of the magnetic flux at (n−1)imax, as this flux value is very sensitive to the disposition of the sheets 20 of the core 1, to the quality of the magnetic material, to any displacement even that produced by heating of the windings, to the value of the flux at $(n+1)i_{max}$, and moreover to the effect related to the frequency. As will be discussed in more details hereinafter, the air gaps 7 and 8 are introduced in the two outer limbs 3 and 4 of the magnetic core for attenuating these different drawbacks and for increasing the range of voltage regulation of the inductor at a determined voltage level. When the slope $\omega L_1$ is reduced by introducing an air gap, the influence of the above-mentioned phenomenons is, if not eliminated, considerably reduced. Another aspect to take into consideration is the coercive current $i_c$ at the frequency of the current $i_p$ for a certain degree of saturation which is attained, and the remanent flux resulting therefrom under the slope $\omega L_1$ when an air gap is provided. Under a simplified form, FIG. 5 illustrates the new magnetization curve modified to take into consideration the remanent flux and the coercive field. Here, the effect caused by the remanent flux which tends to continue to increase with the saturation, thus increasing the slope $\omega L_1$, is neglected.

An appropriate mathematical development demonstrates that the operating peak voltage $V_o$ of the variable inductor with air gaps versus the current $i_{max}$ is reduced by $(\omega L_1-\omega L_2)i_c$ due to the coercive field. The same applies to the intermediary current range of the upper half-curve of FIG. 4 which becomes $$(i_o-i_c)/(n+1)\leqq i_{max}\leqq(i_o-i_c)/(n-1),$$

as well as for all the other expressions in which $i_o$ is replaced by $(i_o-i_c)$. It should be noted here that the modification caused to the waveform of the current by the operation of the inductor following a minor hysteresis loop is not taken into consideration.

Figure 6B:
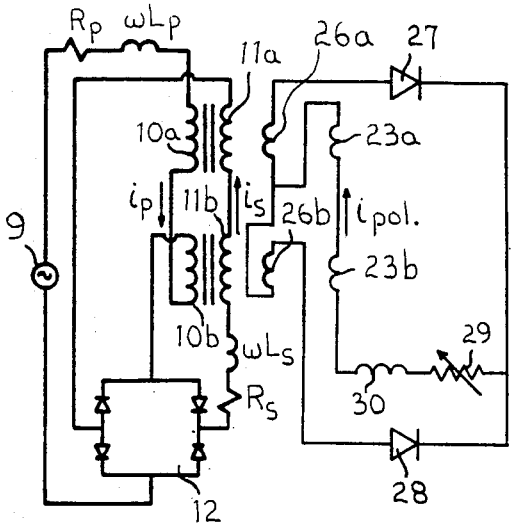

FIGS. 6(*a*) and 6(*b*) show bias winding means comprising windings 23*a* and 23*b* disposed around the outer limbs 3 and 4, respectively. These windings 23*a* and 23*b* are connected in series and wrapped around the limbs 3 and 4 in the same manner as the control windings 11*a* and 11*b* in order to generate a direct current magnetic flux flowing through the closed magnetic circuit defined by the outer limb 3 and 4 in response to a biasing direct current $i_{pol}$. Such a magnetic flux flows in the same direction or in an opposite direction with respect to the direct current magnetic flux generated by the windings 11*a* and 11*b*, according to the direction of the current $i_{pol}$. These windings 23*a* and 23*b* may be supplied as illustrated on FIGS. 6(*a*), through an adjustable direct current source 24 or an adjustable direct current voltage source through a resistor 25. It is advisable to add in this circuit an additional inductor to supply the windings 23*a* and 23*b* with a more constant direct current. Another possibility is as illustrated on FIG. 6(*b*) to dispose on the magnetic core 1 additional winding means comprising two windings 26*a* and 26*b* wrapped around the limbs 3 and 4, respectively, and which produce a current rectified through the diodes 27 and 28 and applied to the windings 23*a* and 23*b* through an adjustable resistor 29 provided to adjust the amplitude of this rectified current, for thereby supplying to the windings 23*a* and 23*b* their direct current $i_{pol}$. An additional inductor 30 may also be added for producing a more constant direct current $i_{pol}$. This biasing current $i_{pol}$ has in the equations exactly the same effect as the coercive current $i_c$. As it can be of either one of the two polarities, it can be used for cancelling the effects of the coercive current $i_c$ or generally to adjust the operating peak voltage $V_o$ at the required level.

In order to increase the quality of the waveform, the different windings are advantageously superposed on the limbs 3 and 4 as illustrated on FIG. 7 so that the air gaps are positioned in their center. The bias winding 23*a* is firstly wrapped on the limb 3, followed by the winding 26*a* if provided, and thereafter in order by the primary winding 10*a* and the control winding 11*a*. Accordingly, the bias winding 23*b* is firstly wrapped on the limb 4, followed by the winding 26*b* if the latter is provided, and thereafter in order by the primary winding 10*b* and the control winding 11*b*.

In the used modelcurve illustrated on FIG. 3, the magnetization half-curve is represented by two linear sections of slopes $\omega L_1$ and $\omega L_2$, whereby causing abrupt changes in the representation of the voltage $V_o$ versus the current $i_{max}$ when $(n+1)i_{max}$ passes by the current value $i_o$ and thereafter when $(n-1)i_{max}$ passes the same current value. Practically, the knee of the magnetization curve is always rounded. This results in a similar rounded knee when $(n+1)i_{max}$ passes from the slope $\omega L_1$ to the slope $\omega L_2$. On the other hand, an inverse rounded knee is produced when $(n-1)i_{max}$ passes in this region. The roundness of the latter knee is to a great extent slighter than that of the first knee, as $(n-1)i_{max}$ for n slightly greater than 1 increases slowly with the current $i_{max}$. These two rounded knees and particularly the latter one have the effect of reducing the range of variation of the current $i_{max}$ in function of the voltage $V_o$ evidenced by the intermediary section of slope m of the half-curve of FIG. 4. It is the reason why it is advisable, as mentioned hereinabove, to use magnetic materials having a magnetization curve with an abrupt knee. It is even more advisable to construct the core 1 and to join its sheets 20 in order to avoid straightening of this knee.

The effects of the air gaps 7 and 8 will now be examined in more details. The introduction of an identical air gap in each of the two outer limbs 3 and 4 reduces the slopes $\omega L_1$ and $\omega L_2$ of the magnetization curve of FIG. 3 and of the minor hysteresis loop illustrated on FIG. 2, particularly the greater slope present at low induction level, namely $\omega L_1$. The suitable approximative formula is the following:

$$\omega L = \frac{\omega N^2 \mu_{air} A_f}{a + l_f(\mu_{air}/\mu_f)}$$

where $\omega L$ is the impedance of the winding wrapped on the limb 3 or 4 of the core (ohms), N is the number of turns of this winding, $A_f$ is the effective cross section of the limb (3 or 4), a is the length of the air gap (meters), $l_f$ is the length of the magnetic circuit associated with the limbs 3 or 4 (meters), $\omega$ is the angular frequency, $\mu_{air}$ is equal to $4\pi\times10^{-7}$, and $\mu_f/\mu_{air}$ is the relative permeability of the material forming the magnetic core.

When a very deep saturation is reached, it is the impedance of the winding in the air which is the most apparent. This impedance in the case of a solenoid may be evaluated by the following approximative formula:

$$\omega L = \frac{\omega\ 2.2\times10^{-6} D_m^2 N^2}{D_m + 2.2\ l}$$

where $\omega L$ is the impedance of the winding in the air (ohms), $D_m$ is the mean diameter of the winding (meters), l is the length of the winding (solenoid) in meters, and the other parameters have been defined hereinabove. A more accurate calculation formula may sometimes be necessary.

In fact, the latter impedance is used to calculate the evolution of the voltage $V_o$ versus the current $i_{max}$ for $i_{max}\geqq i_o/(n-1)$, while the first expression is suitable in the region $i_{max}\leqq i_o/(n+1)$.

The introduction of an air gap has the advantage of considerably reducing the sensitivity of the inductor to any modification of the minor hysteresis loop. In fact, when the slope is very abrupt, important changes in the magnetic flux at $(n-1)i_{max}$ may be caused by the slightest curve variation. As the impedance $\omega L_1$ is greatly reduced by the air gaps, such a phenomenon is attenuated. Accordingly, the adjustment of the ratio n for obtaining a given static characteristic will become less critical as can be seen from the above equations (1) and (2). The introduction of air gaps in the outer limbs 3 and 4 therefore allows a better control of the operating characteristics of the self-controlled inductor, and consequently allows to construct inductors having similar characteristics and to adjust the same in order to obtain a more important range of variation of the current and therefore of the reactive power the inductor can absorb for slight voltage variations and that, at a pre-established voltage level. Indeed, the principal drawback inherent to the prior art was the too great difficulty of adjustment of the parameters of the variable inductor for operation at this voltage level.

Air gaps having a dimension appropriately selected therefore allow to mask the little disparities due to variants in the construction of the magnetic core 1 or in the quality of the sheets 20.

The inductor provided with air gaps has however the disadvantage of having a higher harmonic content in its current $i_p$, compared with the known variable inductors. However, the inductor of fixed value 22 (FIG. 6*a*) may be provided to obtain a sinusoidal current $i_p$ at the operating point. As already mentioned, either filtering or a delta connection in a three-phase system can be used for reducing this harmonic content.

It should be noted here that the resistances remain low compared with the reactive impedances, even in saturation. Consequently the influence of these resistances is negligible, as well as the influence of their increase due to heating of the different windings.

The transient response, more particularly the response time will be briefly discussed hereinbelow.

For the current range $i_{max} \leqq i_o/(n+1)$, an appropriate mathematical development demonstrates that, if the inductor operates at a peak voltage $V_o$ and its initial peak current is then $i_{max} < i_o/(n+1)$, and if a sudden increase of voltage $\Delta V$ is produced, the current after an half-cycle, provided that $\omega L_1$ is great and n slightly greater than 1, is close to the final value.

Concerning the current range $i_o/(n+1) \leqq i_{max} \leqq i_o/(n-1)$, the response time is as rapid as $(\omega L_s + \omega L_p + 4\omega L_2)$ is small. It has also been acknowledged that a great value of $\omega L_s$ increases the time taken for the transition. Therefore, the introduction of the inductor of fixed value 22 (see FIG. 6*a*))increases the response time. However, the latter remains fast.

Last of all, in the current range $i_{max} \geqq i_o/(n-1)$, the response time is as rapid as $(\omega L_s + 2n^2\omega L_2)$ has a value close to the value of $(\omega L_p + 2\omega L_2)$.

In all the cases, the response time is very fast, i.e. of the order of some half-cycles.

It is convenient here to mention that certain applications require that an inductor 32 of fixed value, a capacitor 33, or an inductor 36 of fixed value in series with a capacitor 37 be connected in parallel with the self-controlled variable inductor with air gaps according to the present invention 31, as illustrated on FIGS. 8(*a*) to 8(*c*), so as to obtain a desired operating characteristic of the global system.

The self-controlled variable inductor with air gaps according to the present invention constitutes a relatively simple passive element of regulation of alternating voltage by self-controlled absorption of reactive power, at a given level of the voltage $V_o$ located on the curve section of slope m of FIG. 4.

The variable inductor may be used either as a shunt variable inductor or a static compensator, for an application thereof to the regulation of voltage at a given level through self-controlled absorption of reactive power.

In particular, a very interesting application of the inductor object of the present invention is the regulation of the alternating voltage applied to an electric load supplied by overhead wire, or more generally by capacitive source (capacitive coupling). FIG. 9 represents such a capacitive source having as equivalent circuit a source 38 of voltage V, (which, for example, may be an electric energy transmission line) and a capacitor bank 39 of value C. This source supplies a resistive load R. A self-controlled variable inductor with air gaps according to the present invention 31 is connected in parallel with the load R. A current $i_C$ flows through the bank 39, a current $i_L$ through the inductor 31 and a current $i_R$ through the load R. A voltage $V_C$ appears between the terminals of the bank 39 while a voltage $V_L$ appears between the terminals of the load R and of the inductor 31.

The theory demonstrates that, when the value of the inductor 31 appropriately varies with the value of the load R, the voltage $V_L$ between the terminals of the load R may be maintained constant within a given range. This is carried out with the self-controlled variable inductor including air gaps as above described by selecting the slope m (see FIG. 4) equal to zero. It is even possible, by appropriately modifying the slope m (see FIG. 4) through adjustment of the number of turns of the control windings 11*a* and 11*b* (FIG. 1(*a*)), to carry out a positive regulation of the voltage $V_L$ in function of the load (voltage between the terminals of the load R which increases with this load), for thereby obtaining an optimum transfer of active power from the source 38 to the load R.

Although the present invention has been described by means of a preferred embodiment of the variable inductor, it should be pointed out that any modification to this embodiment as well as any other application of the variable inductor can be made, within the scope of the attached claims, without changing or altering the nature and scope of the present invention.

What is claimed is:

1. Variable inductor comprising:

a magnetic core provided with three limbs each having a first end and a second end, said first ends being interconnected through a first common point of the magnetic core, and said second ends being interconnected through a second common point of said magnetic core;

primary winding means supplied with an alternating current;

control winding means; and means for supplying the control winding means with a direct current having an amplitude which varies in relation with an electric parameter related to the operation of said variable inductor;

said primary winding means and said control winding means being disposed with respect to the magnetic core so that said alternating and direct currents induce in a first of said three limbs an alternating magnetic flux and a direct current magnetic flux which assist each other or which are in opposition with respect to each other when said alternating current has a positive or negative value, respectively, and in a second of said three limbs an alternating magnetic flux and a direct current magnetic flux which are in opposition with respect to each other or which assist each other when said alternating current has a positive or negative value, respectively, the direct current magnetic flux induced in each of said first and second limbs having a density which varies with the amplitude of said direct current for thereby varying the impedance of the primary winding means;

said first limb comprising gap means traversed by the resultant magnetic flux induced in this first limb, and said second limb comprising gap means traversed by the resultant magnetic flux induced in this second limb.

2. Variable inductor according to claim 1, wherein said three limbs are located substantially in a same plane and include two outer limbs as well as a center limb disposed between the two outer limbs.

3. Variable inductor according to claim 2, wherein said first and second limbs of the magnetic core are constituted by said two outer limbs.

4. Variable inductor according to claim 2, in which the magnetic core is formed with stacked sheet elements parallel to said plane and joined together through 45° joints having at least three stages for thereby preventing any partial saturation of the magnetic core.

5. Variable inductor according to claim 1, in which said three limbs of the magnetic core each have a cross section having a same shape and a same area.

6. Variable inductor according to claim 1, in which said first and second limbs of the magnetic core have a same length, wherein said first and second limbs each have a cross section having a same area, and wherein said gap means of said first and second limbs have a same length.

7. Variable inductor according to claim 1, in which the gap means of said first limb are located on this first limb half-way between said first and second common points of the magnetic core, and in which the gap means of said second limb are located on this second limb half-way between said first and second common points of the magnetic core.

8. Variable inductor according to claim 1, in which said three limbs all have a cruciform cross-section which is almost circular.

9. Variable inductor according to claim 1, wherein said magnetic core is made of a magnetic material having a magnetization curve with a pronounced knee.

10. Variable inductor according to claim 1, in which said electric parameter is the amplitude of the alternating current supplying the primary winding means.

11. Variable inductor according to claim 10, in which said direct current supplying means comprise means for rectifying the alternating current supplying the primary winding means and for supplying the control winding means with said rectified current.

12. Variable inductor according to claim 11, in which said rectifying and supplying means comprise a diode bridge interconnecting the primary winding means in series with the control winding means.

13. Variable inductor according to claim 1, in which the primary winding means comprise a first winding and a second winding connected in series, wrapped around said first and second limbs, respectively, and supplied with said alternating current so that this alternating current induces in the first limb a first alternating magnetic flux and in the second limb a second alternating magnetic flux, which first and second alternating magnetic fluxes assist each other in the third of said three limbs.

14. Variable inductor according to claim 1, wherein the control winding means comprise a first winding and a second winding connected in series, wrapped around said first and second limbs, respectively, and supplied with said direct current so that this direct current induces a direct current magnetic flux flowing through a closed magnetic circuit defined by said first and second limbs.

15. Variable inductor according to claim 13, wherein the control winding means comprise a third winding and a fourth winding connected in series, wrapped around the first and second limbs, respectively, and supplied with said direct current so that this direct current induces a direct current magnetic flux flowing through a closed magnetic circuit defined by said first and second limbs.

16. Variable inductor according to claim 15, in which said electric parameter is the amplitude of the alternating current supplying said first and second windings connected in series, and in which said direct current supplying means comprise means for rectifying this alternating current and for supplying with said rectified current the third and fourth windings connected in series.

17. Variable inductor according to claim 15, wherein said first and third windings are superposed, wherein said second and fourth windings are also superposed, wherein said first and third windings are disposed around said first limb so that the gap means of this first limb are located in the center of the first and third windings, and wherein said second and fourth windings are disposed around said second limb so that the gap means of this second limb are located in the center of the second and fourth windings.

18. Variable inductor according to claim 1, comprising an inductor having a fixed value and connected in series with said control winding means.

19. Variable inductor according to claim 1, in which the control winding means comprise a first winding and a second winding connected in series, and in which said variable inductor comprises an inductor having a fixed value and connected in series with said first and second windings of the control winding means.

20. Variable inductor according to claim 1, comprising bias winding means mounted on the magnetic core and supplied with direct current.

21. Variable inductor according to claim 20, wherein said bias winding means are supplied by a direct current source.

22. Variable inductor according to claim 20, in which said bias winding means are supplied with direct current by additional winding means mounted on the magnetic core, said additional winding means supplying the bias winding means through rectifying means and means for adjusting the amplitude of the direct current supplying said bias winding means.

23. Variable inductor according to claim 15, comprising a fifth winding and a sixth winding connected in series, wrapped around said first and second limbs, respectively, and supplied with direct current so that these fifth and sixth windings generate a biasing magnetic flux which flows in the closed magnetic circuit defined by said first and second limbs.

24. Variable inductor according to claim 23, wherein said first, third and fifth windings are superposed, wherein said second, fourth and sixth windings are also superposed, wherein said first, third and fifth windings are disposed around said first limb so that the gap means of this first limb are located in the center of the first, third and fifth windings, and wherein said second, fourth and sixth windings are disposed around said second limb so that the gap means of this second limb are located in the center of the second, fourth and sixth windings.

25. Variable inductor according to claim 15, wherein the third winding has a number of turns equal to n times the number of turns of the first winding, and the fourth winding has a number of turns equal to n times the number of turns of the second winding, n being slightly greater than 1.

26. Variable inductor according to claim 1, wherein a reactive impedance is connected in parallel with said variable inductor in order to obtain a desired operating characteristic given by said reactive impedance and said variable inductor connected in parallel.

27. Variable inductor according to claim 26, wherein the reactive impedance comprises a capacitor.

28. Variable inductor according to claim 26, wherein the reactive impedance comprises an inductor.

29. Variable inductor according to claim 26, wherein the reactive impedance comprises a capacitor connected in series with an inductor.

30. An electric system comprising an electric load, a capacitive source for supplying an alternating voltage to said load, and a variable inductor connected in parallel with the electric load for carrying out a regulation of the alternating voltage supplied to said load, said variable inductor comprising:

a magnetic core provided with three limbs each having a first end and a second end, said first ends being interconnected through a first common point of the magnetic core, and said second ends being interconnected through a second common point of said magnetic core;

primary winding means supplied with an alternating current delivered from said capacitive source;

control winding means; and means for supplying the control winding means with a direct current having an amplitude which varies in relation with an electric parameter related to the operation of the variable inductor;

said primary winding means and said control winding means being disposed with respect to the magnetic core so that said alternating and direct currents induce in a first of said three limbs an alternating magnetic flux and a direct current magnetic flux which assist each other or which are in opposition with respect to each other when said alternating current has a positive or negative value, respectively, and in a second of said three limbs an alternating magnetic flux and a direct current magnetic flux which are in opposition with respect to each other or which assist each other when said alternating current has a positive or negative value, respectively, the direct current magnetic flux induced in each of said first and second limbs having a density which varies with the amplitude of said direct current for thereby varying the impedance of the primary winding means;

said first limb comprising gap means traversed by the resultant magnetic flux induced in this first limb, and said second limb comprising gap means traversed by the resultant magnetic flux induced in this second limb.

* * * * *